United States Patent [19]

Byrne

[11] Patent Number: 5,009,901

[45] Date of Patent: Apr. 23, 1991

[54] METHOD OF PACKAGING A BEVERAGE AND A BEVERAGE PACKAGE

[75] Inventor: William J. Byrne, Mount Merrion, Ireland

[73] Assignee: Arthur Guinness Son & Company (Dublin) Limited, Dublin, Ireland

[21] Appl. No.: 345,639

[22] Filed: Apr. 28, 1989

[30] Foreign Application Priority Data

Sep. 12, 1988 [GB] United Kingdom ..... 8821265

[51] Int. Cl.[5] ..... B65D 85/72; B65B 31/00; B65B 81/20

[52] U.S. Cl. ..... 426/112; 426/115; 426/131; 426/397; 206/219; 220/906; 53/410; 53/433

[58] Field of Search ..... 53/410, 423, 432, 433, 53/467, 470, 471, 474, 97, 510, 511; 426/112, 115, 118, 119, 131, 394, 395, 397; 215/1 C, 6, DIG. 8; 206/216, 219, 221; 220/1 BC

[56] References Cited

U.S. PATENT DOCUMENTS

| | | | |
|---|---|---|---|
| 55,341 | 6/1866 | Morse | 215/6 |
| 378,752 | 2/1888 | Ader | 215/6 |
| 611,520 | 9/1898 | Smith | 206/221 |
| 3,145,838 | 8/1964 | Van Deusen | 206/221 |
| 3,282,708 | 11/1966 | Cushman | 426/394 X |
| 3,717,274 | 2/1973 | Wingardh | 215/1 C |
| 3,733,771 | 5/1973 | Megowen | 53/471 |
| 3,978,232 | 8/1976 | Dodsworth et al. | 426/115 |
| 4,438,856 | 3/1984 | Chang | 215/1 C X |
| 4,627,986 | 12/1986 | Bardsley et al. | 426/112 |
| 4,832,968 | 5/1989 | Forage et al. | 426/131 X |

FOREIGN PATENT DOCUMENTS

| | | | |
|---|---|---|---|
| 1266351 | 3/1972 | United Kingdom | 426/112 |
| 2182762 | 5/1987 | United Kingdom | 220/1 BC |

*Primary Examiner*—Horace M. Culver

[57] ABSTRACT

A method of packaging a beverage containing gas in solution and a beverage package has a chamber 9 in a moulded open topped container 1 (of plastics or metal) in a bottom wall 8 of which is formed a restricted orifice 10. The bottom of the container 1 is received in a cup shaped closure 11 and sealed thereto at 16 to form a chamber 12 which communicates with the chamber 9 through the orifice 10. The chamber 9 is charged with beverage 17 and its headspace 21 is dosed with liquid nitrogen or carbon dioxide prior to sealing with a cap 18 so that the headspace 21 is at a pressure greater than atmospheric. With the sealed package in equilibrium the chamber 12 contains beverage derived from the chamber 9 through the orifice 10 and has a headspace 22. Upon opening of the package by removing the cap 18 and exposing the headspace 21 to atmosphere, the pressure differential between the headspaces 21 and 22 causes beverage and/or gas in the chamber 12 to be ejected through the orifice 10 into the beverage 17 and thereby gas in solution in the beverage to be liberated to form or assist in the formation of a head of froth on the beverage.

12 Claims, 1 Drawing Sheet

METHOD OF PACKAGING A BEVERAGE AND A BEVERAGE PACKAGE

TECHNICAL FIELD & BACKGROUND ART

This invention relates to a method of packaging a beverage and to a beverage package and particularly concerns beverages containing gas in solution and packaged in a sealed container which, when opened for dispensing or consumption of the beverage, permits gas to be evolved or liberated from the beverage to form, or assist in the formation of, a head or froth on the beverage. The beverages to which the invention relates may be alcoholic or non-alcoholic and will be packaged in a two chambered container so that when the container is opened, gas and/or beverage from one chamber is ejected into beverage in the other chamber to cause gas in solution in the beverage to evolve and form a head of froth. Advantages which are to be derived from such two chambered beverage packages and methods of packaging the beverage in the containers are discussed in our British Patent Specification No. 2,183,592A. A further example of a two chambered beverage package of the type referred to is disclosed in our British Patent Specification no. 1,266,351 (which is also referred to in the aforementioned G.B. No. 2,183,592A).

The method of packaging the beverage in a two chambered container as proposed in G.B. No. 1,266,351 was found to be unacceptable commercially in view of difficulties experienced in gas pressurising one of the chambers in the container and efficiently sealing the container following such pressurisation. On the contrary, however, the preferred method of packaging the beverage disclosed in G.B. No. 2,183,592A in which one of the two chambers is provided by a hollow pod which is inserted within the container has met with considerable commercial success. Nevertheless, this latter packaging method is inconvenient and relatively expensive in so far as a conventional beverage container/packaging line has to be modified considerably, especially to provide for the insertion of the pre-formed hollow pods into the container prior to the container being charged with its required volume of beverage. It is an object of the present invention to provide an efficient method of packaging a beverage in a two chambered container as broadly envisaged by the disclosure in G.B. No. 2,183,592A and which method alleviates the requirement for inserting a hollow pod into a preformed container as a means for forming one of the chambers.

STATEMENT OF INVENTION & ADVANTAGES

According to the present invention there is provided a method of packaging a beverage having gas in solution therewith which comprises forming an open topped container body having a primary chamber and with a restricted orifice in a bottom wall portion of the container body; sealing a closure wall to the exterior of the container body to form a sealed secondary chamber which communicates with the primary chamber through said restricted orifice; charging the primary chamber with the beverage and sealing the primary chamber to provide a primary headspace therein with a pressure greater than atmospheric so that beverage enters the secondary chamber from the primary chamber through said restricted orifice to form a secondary headspace in the secondary chamber when the contents of the package are at equilibrium.

Further according to the present invention there is provided a beverage package comprising a container body having an openable top and which forms a primary chamber that is charged with beverage containing gas in solution to provide a primary headspace therein which headspace has a pressure greater than atmospheric; a bottom wall portion of the container body which has a restricted orifice therein; a closure wall sealed to the exterior of the container body to form therewith a sealed secondary chamber that communicates with the primary chamber through said restricted orifice; said secondary chamber being charged with beverage derived from the primary chamber by way of the restricted orifice to provide a secondary headspace in the secondary chamber which secondary headspace has a pressure greater than atmospheric when the contents of the package are at equilibrium.

By the present invention it is envisaged that the container body will be formed as one piece, conveniently moulded, for example by blow moulding techniques in plastics material (such as that known in the art as PET or polyethylene) or glass or by pressing or stamping techniques in sheet metal. The open top for the container body and to the primary chamber will be sealed following the beverage charging and the container will be reopenable, for example by sealing the open top with a removable screw stopper or cap (usually with a bottle or jar-like configuration to the container body) or with a rip-off portion having a pull tag as is well known in the art of canned beverages. Consequently the container body may be of profile conventional for beverage container and in a bottom wall portion of which is provided the restricted orifice which, typically, will have a diameter in the order of 0.010 to 0.015 inches (0.25 to 0.38 millimeters). The restricted orifice can be formed during or subsequent to the formation of the container body, for example by providing an appropriately located pin onto which the body is moulded or by drilling or boring (for example by laser) the container body.

Many conventional single chamber containers for beverages, such as bottles blow moulded in plastics or cans moulded by pressing sheet metal, have their bottom wall portion or base profiled to provide a recess on the exterior of the container and this recessed portion can conveniently serve as a substantial part of the secondary chamber which can be formed by sealing a closure wall to the exterior of the container.

The closure wall may be attached to the exterior of the container body by use of a welding technique, or bonding with a hot melt adhesive, glue or otherwise to form the secondary chamber which is sealed other than for the restricted orifice through which it communicates with the primary chamber. The closure wall is preferably cup-shaped and receives the bottom portion of the container body. The cup-shaped closure wall may be sealed to the container body around its rim and can provide a convenient base on which the beverage package normally stands.

The shape of the secondary chamber and the location of the restricted orifice in the bottom wall portion should be such that following the package being sealed and the formation of headspaces in the primary and secondary chambers, a substantial headspace will always be maintained in the secondary headspace irrespective of the orientation of the package (and such vibration which the package may reasonably be expected to experience during use). Preferably the restricted orifice is positioned adjacent to the closure wall and at a location where the secondary headspace will be maintained. The bottom wall portion may have an undulating or corrugated profile with the restricted orifice located centrally of the container body and adjacent to the closure wall to ensure that the secondary headspace is maintained.

The beverage and gas (or gases) which it contains and the gas or gases which comprise the headspaces are preferably as discussed in our Specification G.B. No. 2,183,592A. The beverage may therefore, typically, be fermented such as beer, stout, ale, lager and cider, be a so-called soft drink such as fruit juice, squash, cola, lemonade, milk and milk-based drinks or be a more alcoholic type drink such as spirits, liquers, wine or wine based drinks. The gas is typically at least one of carbon dioxide gas and inert gas (which latter term includes nitrogen).

By the present invention it is envisaged that a typical package will be formed by charging the primary chamber through the open top of the container body. The open top is then closed to form a sealed package under conditions in which the primary headspace in the primary chamber is at a pressure greater than atmospheric. This latter condition may be achieved by sealing the container body under environmental conditions provided by, for example, carbon dioxide and/or nitrogen gas at a pressure greater than atmospheric or by dosing the surface of the beverage in the primary chamber with liquid nitrogen or liquid carbon dioxide so that the evaporation of the gas develops the required pressure for the headspace in the sealed package. The aforementioned liquid nitrogen or carbon dioxide dosing has the advantage that its evaporation prior to sealing the package may purge the headspace in the primary chamber of air. It is preferred that both the primary and secondary chambers are purged of air, for example by use of known nitrogen or carbon dioxide gas exchange techniques, prior to the primary chamber being charged with the beverage.

The open topped container body will typically be sealed with a screw stopper, screw cap, rip-off plug or seal in the case of bottles or with a metal closure sheet which can be seamed in conventional manner to a rim of the container body in the case of cans.

The package provided by the present invention will function in the manner of the beverage package discussed in our G.B. No. 2,183,592A whereby when the beverage and headspaces in the primary and secondary chambers are in equilibrium and the container body is opened to expose the primary chamber to atmosphere, the pressure differential between the primary and secondary headspaces causes beverage and/or gas in the secondary chamber to be ejected by way of the restricted orifice into the beverage in the primary chamber and such ejection liberates gas from solution in the beverage to form or assist in the formation of a head of froth on the beverage. It will also be appreciated that the beverage may be pasteurised, prior or subsequent to the package being sealed.

DRAWINGS

One embodiment of a sealed beverage package formed by the method of the present invention will now be described, by way of example only, with reference to the accompanying illustrative drawings in which.

DETAILED DESCRIPTION OF DRAWINGS

Figure 1:
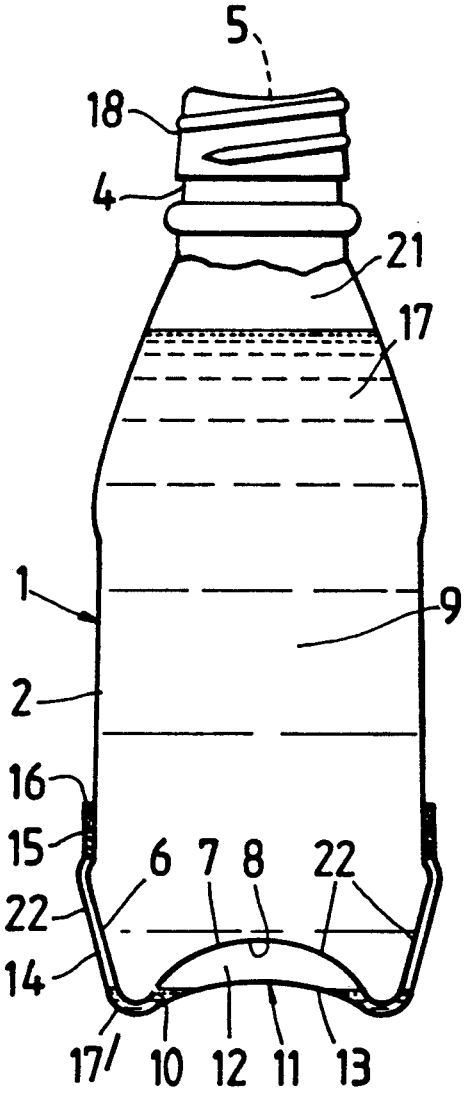
FIG. 1 is a side elevation of the sealed package in part section.

The package shown in FIG. 1 predominantly comprises a blow moulded plastics bottle which is formed, for example, in high density polyethylene and comprises a generally cylindrical side wall 2 which converges through a frusto conical wall portion 3 at its upper end to an externally screw threaded neck 4 of an open top 5. The lower end of the plastics bottle converges through a frusto conical wall portion 6 to a bottom wall portion 7 which provides a dome shaped recess 8 on the exterior of the bottle 1. The bottle 1 forms a primary chamber 9 having a capacity of approximately 500 mls.

Simultaneously with, or subsequent to, the moulding of the bottle 1, a restricted orifice 10 having a diameter in the order of 0.015 inches (0.38 millimeters) is formed in the bottom wall portion 7 adjacent to the junction between that wall portion and the frusto conical wall portion 6.

The bottom end of the bottle 1 is received in a moulded plastics cup-shaped closure wall 11, preferably of the same plastics material as that from which the bottle 1 is moulded. It will be seen from FIG. 1 that the cup 11 has a similar profile to that of the bottom end of the bottle 1 but is of slightly larger dimensions so that a secondary chamber 12 is formed between the cup bottom 13 and the bottom wall portion 8 and between the frusto conical wall portion 6 and an opposing upstanding peripheral side wall 14 of the cup 11.

The upstanding side wall 14 of the cup has a rim 15 and this rim is sealed at 16 circumferentially around the plastics wall 2 of the bottle. The sealing between the cup and bottle is conveniently effected with a hot melt adhesive. The secondary chamber 12 formed between the bottle 1 and cup 11 is thus sealed other than for the restricted orifice 10 through which it communicates with the primary chamber 9. The secondary chamber 12 will, typically, have a volume of approximately 15 mls.

A bottle structure having a profile similar to that shown in FIG. 1 is known for single chamber beverage packages where an external bottom cup is provided merely for strengthening purposes and to provide a stable base for the package.

The bottle 1 and cap 11 structure is preferably subjected to a known gas exchange process whereby the primary and secondary chambers 9 and 12 are purged of air with one or more gases selected from carbon dioxide gas and inert gas—nitrogen gas being that preferred.

The primary chamber 9 is now charged through the open top 5 with approximately 440 mls of beverage such as stout 17. The surface of the beverage 17 in the bottle 1 is dosed with liquid nitrogen or liquid carbon dioxide (and again nitrogen is preferred) immediately prior to the open top 5 of the bottle 1 being sealed with a screw threaded metal cap 18. The contents of the sealed package thus formed can now adjust to a condition of equilibrium during which the liquid nitrogen evaporates, pressure within the package increases and beverage 17 from the primary chamber 9 flows by way of the restricted orifice 10 into the secondary chamber 12 (as indicated at 17') to provide a primary headspace 21 in the primary chamber 9 and a secondary headspace 22 in the secondary chamber 12. The dosing with liquid nitrogen ensures that the headspaces 21 and 22 are at a pressure greater than atmospheric and, typically, the final pressure in the package will be in the order of 40 pounds per square inch (2.81 Kg per sq. cm).

The beverage 17 will typically contain nitrogen and carbon dioxide gases in solution in the proportions envisaged in G.B. No. 2,183,592A and when the upstanding package is opened by removing the cap 18, the pressure in headspace 21 rapidly reduces to atmospheric so that there is a considerable pressure differential between the secondary headspace 22 and the primary headspace 21. This causes beverage 17' in the secondary chamber 12 to be ejected through the restricted orifice 10 into the beverage 17 in the primary chamber 9 and thereby gas in solution in the beverage to be evolved to form or assist in the formation of a head of froth on the beverage.

Figure 2:
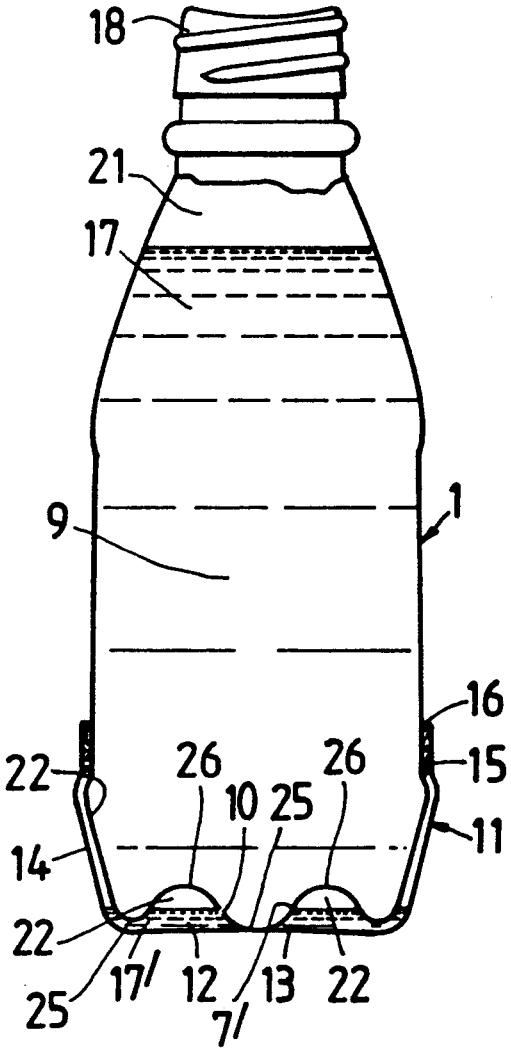
FIG. 2 is a similar view to that in FIG. 1 and shows a modified form of bottom wall portion of a container body in the package.

It will be noted from FIG. 1 that the restricted orifice 10 is located at a position whereby the secondary headspace 22 will be maintained with an adequate volume to achieve ejection of the beverage 17' for the intended purpose upon opening of the package and irrespective of the orientation or vibration to which the sealed package is likely to have been subjected, for example during transport. The maintenance of the secondary headspace is particularly assisted by the portions of that headspace which will be retained between the side wall 14 of the cup and the opposing frusto conical bottle wall 6 and in the uppermost central part of the domed recess 8. It will be realised however that the profile of the secondary chamber 12 can be varied to ensure the maintenance of an appropriate headspace and such variations are conveniently achieved by using alternative mould forms for the bottom wall portion 7. For example a modified profile for the bottom wall portion indicated at 7' is shown in FIG. 2 whereby that portion has a corrugated profile with concentric annular troughs 25 and crests 26. The troughs and crests are coaxial with the axis of the bottle 1 and it will be seen that the restricted orifice 10 is located in a trough 25 adjacent to the bottom 13 of the closure wall 11 and substantially centrally of the bottom of the bottle. With such an arrangement the secondary headspace 22 can be maintained with a required volume irrespective of the orientation of the package.

I claim:

1. A beverage package comprising a container body having an operable top that communicates with a sealed primary chamber in the container body which is charged with beverage containing gas in solution to provide a primary headspace therein, said headspace having a pressure greater than atmospheric; a bottom wall portion of the container body which has a restricted orifice therein; a closure wall sealed to the exterior of the container body to form therewith a sealed secondary chamber that is in constant communication with the primary chamber through said restricted orifice; said secondary chamber being charged with beverage derived from the primary chamber by way of the restricted orifice to provide a secondary headspace in the secondary chamber which secondary headspace has a pressure greater than atmospheric when the contents of the package are at equilibrium so that when the beverage package is opened at said openable top, the primary headspace reduces to atmospheric pressure and pressure in the secondary headspace causes beverage from the secondary chamber to be ejected by way of the restricted orifice into the beverage in the primary chamber for forming a head of froth on said beverage in the primary chamber.

2. A beverage package as claimed in claim 1 in which the container body is formed as one piece in a material selected from plastics.

3. A beverage package as claimed in claim 1 in which the openable top comprises means selected from a removable stopper.

4. A beverage package as claimed in claim 1 in which the bottom wall portion is recessed to provide a concave surface on the exterior of the container which surface defines part of the secondary chamber.

5. A beverage package as claimed in claim 4 in which the bottom wall portion has a profile selected from an undulating profile and a corrugated profile to present said concave surface.

6. A beverage package as claimed in claim 1 in which the closure wall is sealed to the exterior of the container body by means selected from welding and bonding.

7. A beverage package as claimed in claim 1 in which the closure wall is cup shaped and the bottom portion of the container body is received in said cup shape.

8. A beverage package as claimed in claim 7 in which the closure wall is sealed to the container body around a rim of said cup shape.

9. A beverage package as claimed in claim 1 in which the container body is formed as one piece in a material selected from metal.

10. A beverage package as claimed in claim 1 in which the container body is formed as one piece in a material selected from glass.

11. A beverage package as claimed in claim 1 in which the openable top comprises means selected from a removable cap.

12. A beverage package as claimed in claim 1 in which the openable top comprises means selected from a rip-off portion and a pierceable portion on the container body.

* * * * *